United States Patent [19]

Lechevallier

[11] 4,411,412

[45] Oct. 25, 1983

[54] METALLURGICAL CONTAINER FOR THE INDUCTIVE TREATMENT OF METAL

[75] Inventor: Christian Lechevallier, Louverne, France

[73] Assignee: Institut de Recherches de la Siderurgie Francaise, Saint-Germain-en-Lay, France

[21] Appl. No.: 323,907

[22] Filed: Nov. 23, 1981

[30] Foreign Application Priority Data

Nov. 21, 1980 [FR] France ..... 80 24847

[51] Int. Cl.[3] ..... F27B 14/06

[52] U.S. Cl. ..... 266/242; 266/275; 373/154; 373/165

[58] Field of Search ..... 266/275, 276, 242; 373/154, 158, 165

[56] References Cited

U.S. PATENT DOCUMENTS

| | | | |
|---|---|---|---|
| 1,823,873 | 9/1931 | Brace | 373/158 |
| 4,123,045 | 10/1978 | Michelet et al. | 266/275 |
| 4,183,508 | 1/1980 | Michelet et al. | 266/275 X |

*Primary Examiner*—L. Dewayne Rutledge
*Assistant Examiner*—David A. Hey
*Attorney, Agent, or Firm*—Michael J. Striker

[57] ABSTRACT

A metallurgical container for the inductive treatment of metals comprises an inner lining of refractory material and a generally tubular enclosure comprising an upper annular casing surrounding the upper open end of the inner lining, a lower annular casing surrounding the bottom of said container, and a plurality of circumferentially spaced metallic tie rods extend parallel to each other through a median heating zone of the container. A plurality of connecting elements respectively extending through openings in the bottom wall of the upper casing and the top wall of the lower casing, electrically insulated from those walls, tightly connect opposite ends of the tie rods to each wall. The tie rods and the connecting elements are formed with coaxial channels for the passage of cooling fluid therethrough which is fed into one of the casings and discharged from the other.

The container according to the present invention permits powerful inductive treatment of metal and metal alloys, especially steel.

8 Claims, 5 Drawing Figures

METALLURGICAL CONTAINER FOR THE INDUCTIVE TREATMENT OF METAL

BACKGROUND OF THE INVENTION

The present invention relates to a metallurgical container with a fragmented metallic enclosure, used for inductive treatment of metal and metal alloys, especially steel.

The practice of treatment of metal, and especially of steel, is directed more and more toward a metallurgy "outside a blast furnace," that is, "to a metallurgical process in a container." Such a solution runs against a delicate problem of heating metal in a container. The electric heating by induction has the advantage of transmitting the energy to the mix of the metallic charge with an excellent thermic output. Nevertheless, such heating creates undesirable Foucault currents in the metallic elements of the enclosure. From this results, that the enclosure is overheated, and that after a certain number of operations, it will loose its mechanical holding power due to excessive thermal strains. On the other hand, the enclosure of the container has to support strong pressures exercised by the molten metal.

Thus, it is necessary to produce a metallurgical container which satisfies two requirements: On the one hand, to avoid heating by Foucault currents of the parts which are placed within the magnetic heating field, and, on the other hand, to assure the mechanical strength of the metallurgical container.

In this respect, the French Pat. Nos. 2,366,079; 2,368,542; 2,368,543; 2,368,326 and 2,370,797, in the name of the inventor of the present invention, propose metallurgical containers of the type mentioned above. More specifically, French Pat. No. 2,370,797 describes a metallurgical container a vertical cross section of which is schematically illustrated in FIG. 1.

As can be seen from FIG. 1, the metallurgical container according to the prior art is provided with a refractory lining 1. The metallic enclosure 2 of the container is fragmented, and it is constituted, in the heat zone, that is with regard to the inductive winding 3, by metallic longitudinally extending tubular tie rods 4, constructed for the passage of a cooling fluid therethrough. The tubular tie rods 4 are maintained in place between two annular flanges, that is the upper flange 5 and the lower flange 5', which are respectively rigidly connected to a sleeve 6 and to the bottom 7 of the container.

The sleeve 6 serves to hoop or surround the refractory lining 1 at an upper end portion thereof, and it includes two rings, that is the upper ring 8 and the lower ring 9 fixedly connected thereto, wherein the lower ring 9 serves to support the container at the time of its installation and means for induction heating.

The tie rods 4 are connected to the flanges 5 and 5' by connecting means 10 so as to present an internal axial passage 11 which is connected through the ring 9 in the zone 12 defined between the rings 8 and 9 by means of the connecting means 10 and a fluid-tight extension 13. The cooling fluid is introduced at the lower end of the tie rods 4, passes successively through the passage 11, the connecting means 10, the fluid-tight extension 13, and escapes in the zone 12.

The inventor has studied the thermic evolution of the metallic members of a metallurgical container of this type during the intensive treatment by inductive heating. Indeed, it is necessary to effect an extensive heating treatment, that is a treatment in which high electric currents are used and the duration of the heating is extended. On the other hand, during such treatments, it is necessary to avoid excessive heating of the metallic elements of the metallurgical container.

In order to study the thermic evolution, five thermoelectric couples have been placed at different points of the metallurgical container, that is at the points A, B, C, D and E as indicated in FIG. 1. FIG. 2 represents the results of this study.

In FIG. 2, the various curves indicate the temperature (in centigrade) as a function of time (in hours) for the different points A, B, C, D and E of the container.

As can be seen from these curves, the highest temperature of the container (450° C.) is obtained at the upper flange 5, and even though the same is outside of the heating zone. The temperature reached at the lower flange 5' and at the sleeve 6 is essentially lower (350° C.). The temperature at the bottom 7 and that of the tie rods 4 is lowest (150° C.), which confirms the efficiency of the internal cooling described above.

These studies have shown that the metallurgical container of the prior art described above is usable for medium heating but that, for a more forceful heating, the thermic strains from rapid heating of the flanges will create serious problems.

SUMMARY OF THE INVENTION

It is an object of the present invention to provide a metallurgical container in which the metallic elements thereof are not excessively heated during extensive heating of the container and maintain at the same time a high mechanical strength.

With this and other objects in view, which will become apparent as the description proceeds, the metallurgical container of the present invention for the inductive treatment of metal mainly comprises a lining of refractory material and a generally tubular enclosure constituted at a median heating zone of the container by a plurality of circumferentially spaced metallic tie rods electrically insulated from each other and extending with opposite ends beyond the heating zone, the tie rods being tightly secured at upper and lower ends of the enclosure, and the upper portion of the enclosure being constituted by an annular casing surrounding the open end of the lining, and electrically insulated connecting means between the upper ends of the tie rods and the bottom wall of the upper casing.

Preferably, the lower portion of the enclosure is constituted by an annular lower casing, and the lower ends of the tie rods are connected to the top wall of the lower casing by electrically insulating connecting means.

The bottom wall of the upper casing and the top wall of the lower casing are preferably each formed with a plurality of circumferentially spaced bores therethrough, respectively aligned with each other, and the connecting means comprise in this event a plurality of elongated connecting elements provided with outer screwthreads at least at one end portion thereof and respectively extending through the bores and threadingly connected to the lower and upper ends of the tie rods.

Each of the elongated connecting elements may be provided at both end portions thereof with a screwthread, and the screwthread at one end of each connecting means being threadly connected to an end of a respective tie rod, whereas a nut is threadingly connected to the other screwthread at the other end of each connecting element.

The connecting elements extend with clearance through the bores, and this arrangement includes a sleeve of insulating material surrounding the portion of each connecting element in the bore and washers of insulating material at opposite ends of each sleeve.

According to a preferred construction, each of the tie rods and each of the elongated connecting elements is provided with a channel extending in longitudinal direction therethrough, respectively aligned with each other for the passage of cooling fluid, the aligned channels communicating respectively with the upper and lower casing. This arrangement also includes means for feeding a cooling fluid into one of the casings and means for discharging cooling fluid from the other casing.

Each of the casings is preferably provided in its peripheral wall with a plurality of circumferentially spaced openings which are respectively arranged to provide access to the connecting elements to facilitate assembly of the outer enclosure, and of course these openings are closed after the assembly.

It will be understood that the metallurgical container according to the present invention has a great advantage over the metallurgical container of the prior art described above, in that the upper and lower annular casings may be quickly cooled. Thus, the drawbacks of the prior-art construction, due to the excessive heating of the flanges of the metallurgical container, are avoided. Furthermore, the upper and lower annular casings according to the present invention also function to maintain the tie rods in place and tensioned, due to the particular construction of the connecting means between the tie rods and the annular casings. In addition, the mounting and dismounting of the tie rods can be effected in a simple manner, to be further explained below.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
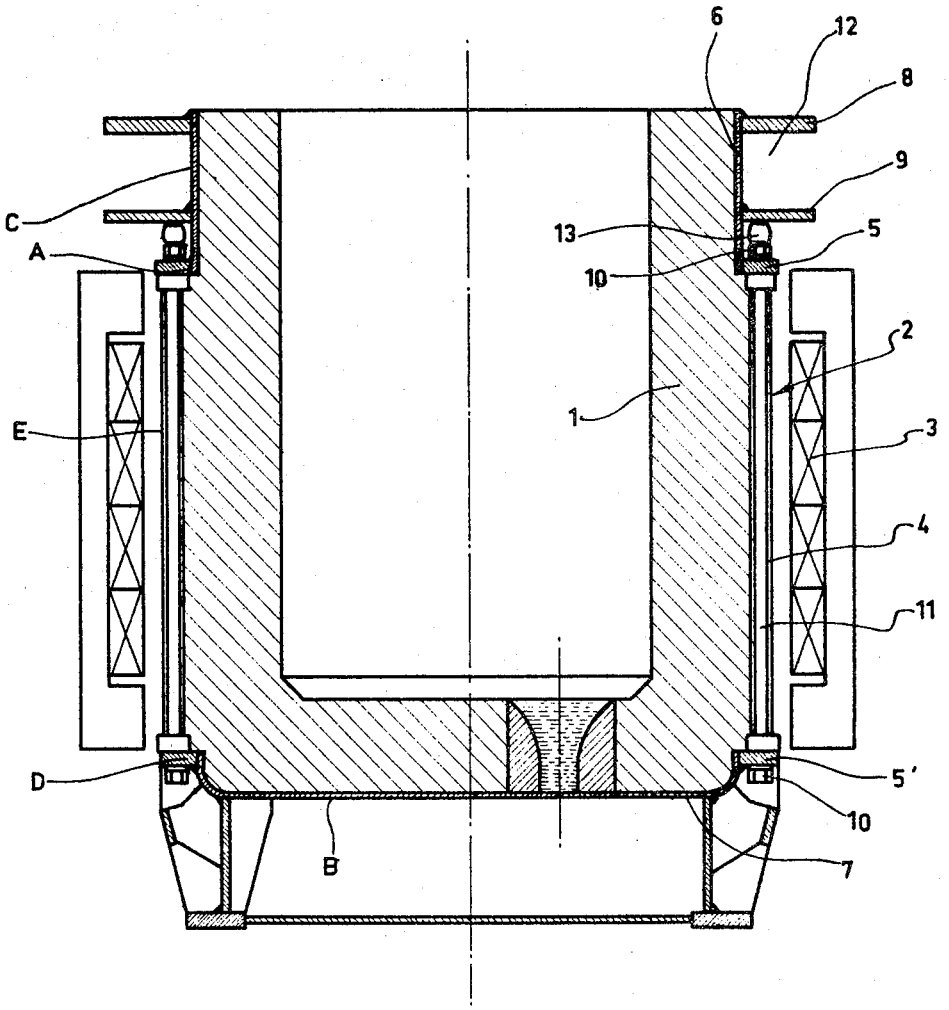
Fig 1 PRIOR ART
FIGS. 1 and 2 described above relate to the prior art.
Figure 2:
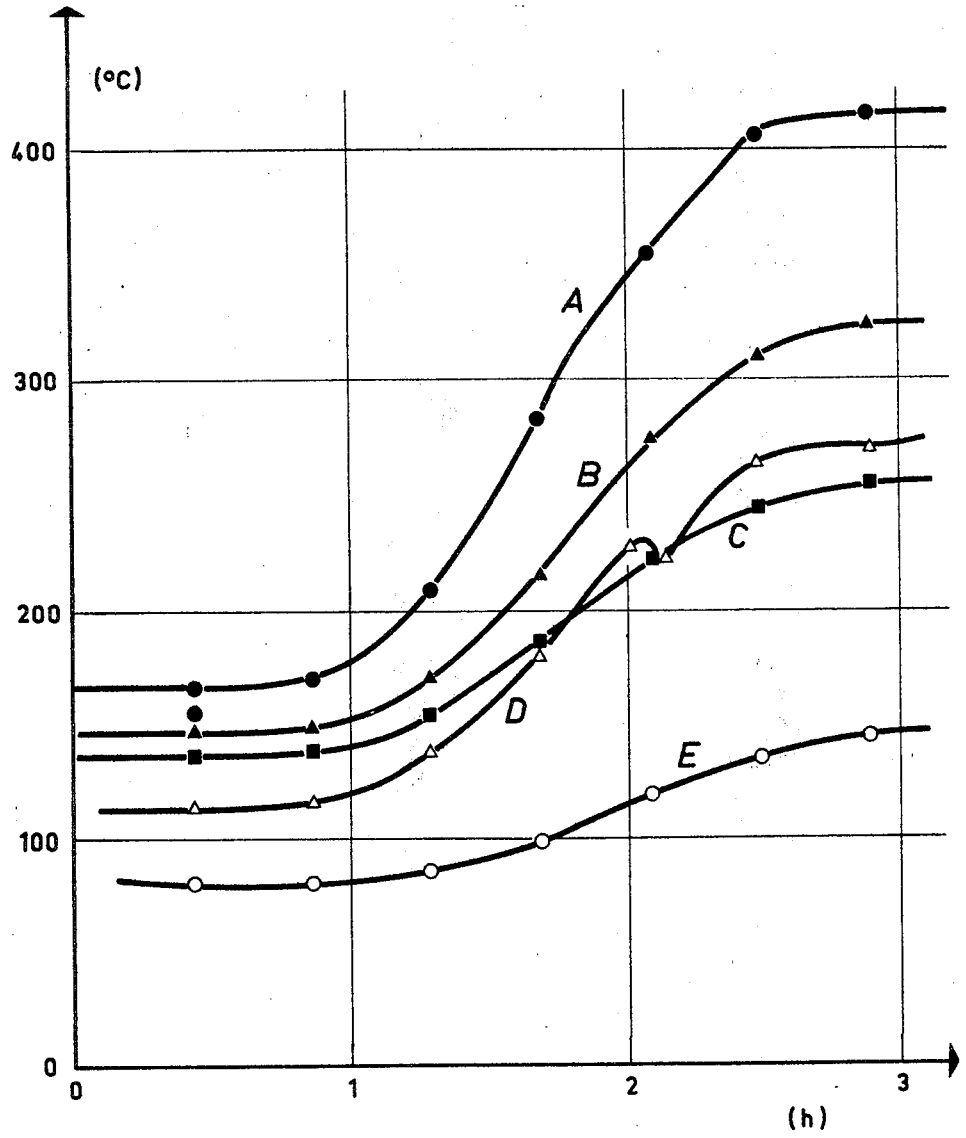
Figure 3:
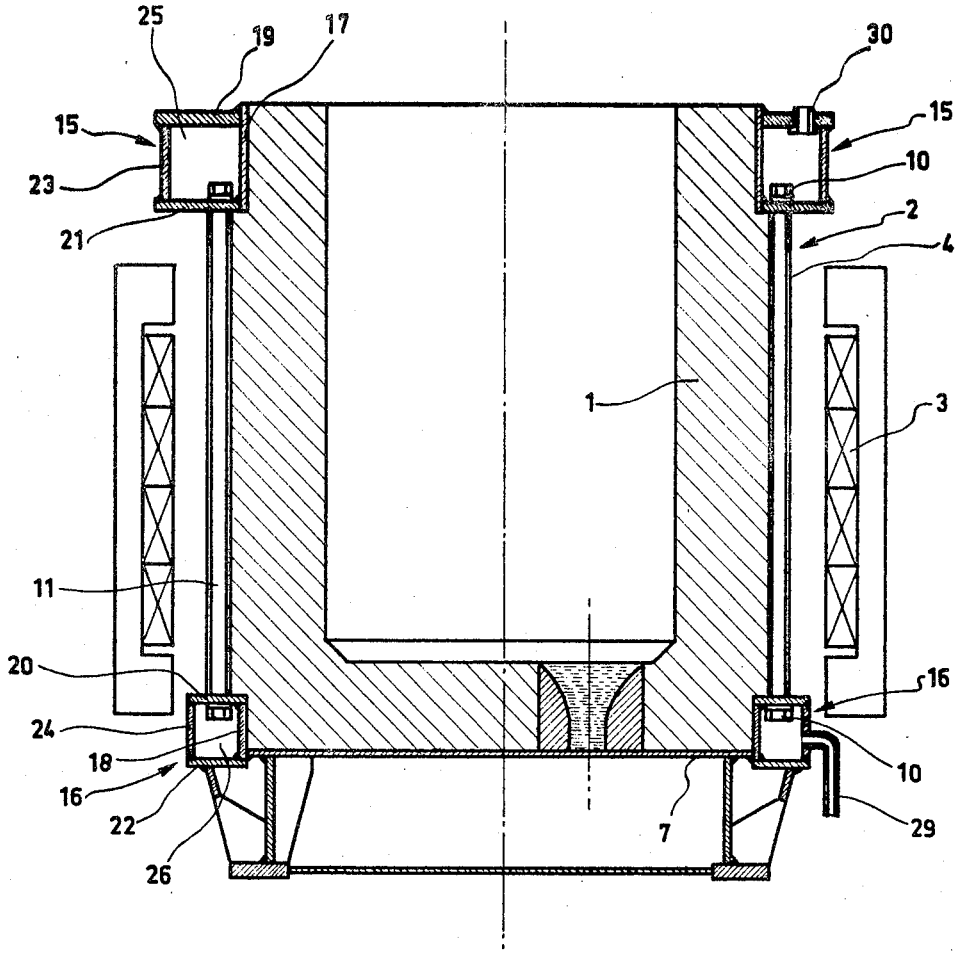
FIG. 3 is a vertical cross section through one embodiment of a metallurgical container according to the present invention.
Figure 4:
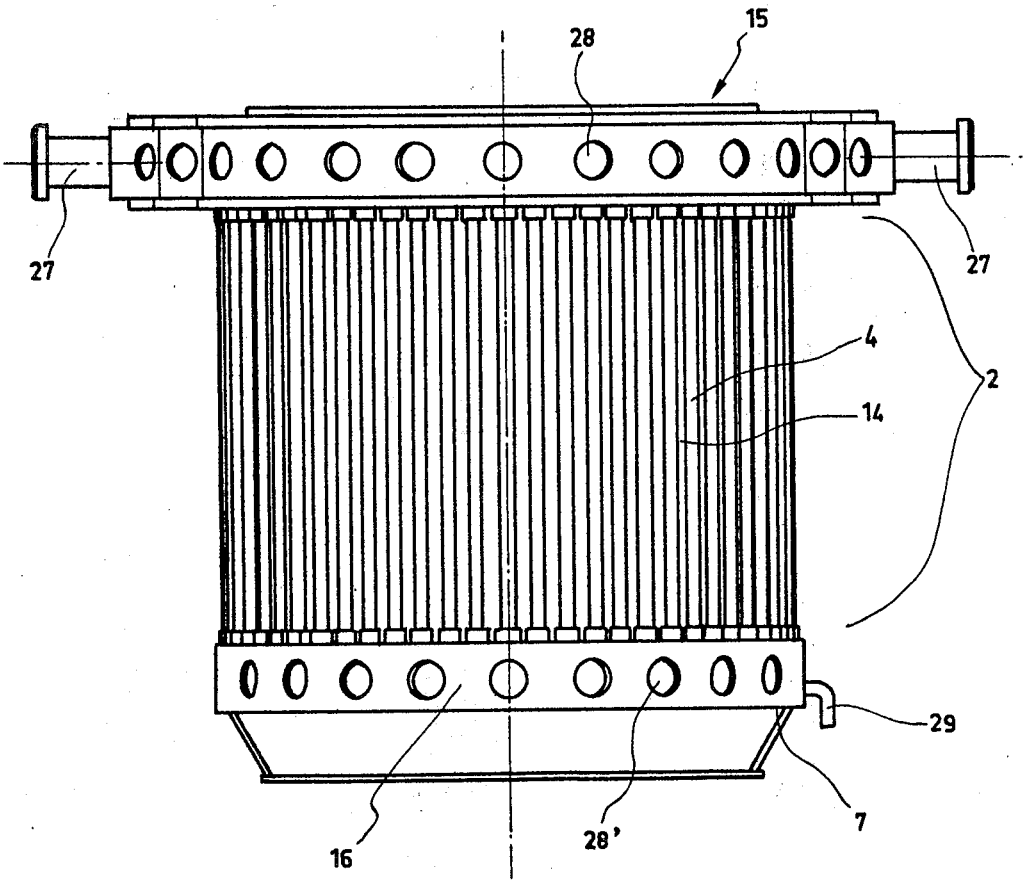
FIG. 4 is a side view of the embodiment shown in FIG. 3.

Referring now to FIGS. 3 and 4, in which a metallurgical container according to the present invention for the inductive treatment of metal is illustrated, it will be seen that the container comprises an inner lining 1 of refractory material. The enclosure 2 of the container is constituted in a medium heating zone thereof by inductive heating by a great number of metallic tie rods 4 which are circumferentially spaced from each other. The tie rods 4 are formed of a non-magnetic material, for instance stainless steel, in order not to canalize the lines of the magnetic field so that the latter may pass through the metal in the container for treating the metal. As can be seen from FIG. 4, the tie rods 4 are uniformly distributed about the lining 1 of refractory material. The spaces between successive tie rods 4 are occupied by joints 14 of refractory material.

The enclosure includes further at its upper portion an upper annular casing 15 and a lower annular casing 16 at the lower end of the enclosure. The upper casing 15 is constituted by an inner peripheral wall or sleeve 17 abutting against the outer peripheral surface of the refractory lining 1 and an outer peripheral wall 23 and these walls are connected at the upper ends by a top wall 19 and at the lower ends by a bottom wall 21 to thus define in the upper casing 15 an interior space 25. The lower casing 16 is likewise constituted by an inner peripheral wall or sleeve 18 engaging the outer peripheral surface of the refractory lining 1 in the region of the lower end, an outer peripheral wall 24, and these two walls are again connected spaced from each other by a top wall 20 and a bottom wall 22 to define in the lower casing an interior space 26. The tie rods 4 are maintained in place and under tension between the upper casing 15 and the lower casing 16 by connecting means 10.

As shown in FIG. 4, the upper casing 15 comprises a plurality of laterally extending trunnions 27 for occasionally handling the container. The upper casing 15 has, besides the function of tightening and maintaining the refractory lining 1, the additional function of supporting by its bottom wall 21 the container within means for heating the same by induction, schematically indicated in FIG. 3 and including electrical induction coils 3.

The casings 15 and 16 further comprise in its outer peripheral walls 23 and 26 a plurality of openings 28 in order to provide access to the assembly means 10. These openings 28 are closed after the assembly means 10 have been properly connected to opposite ends of the tie rods 4.

In the embodiment illustrated in FIGS. 3 and 4, a conduit 29 communicates with the interior of the lower casing 16 for feeding a cooling fluid under pressure, which is generally air, into the lower casing. The cooling fluid will rise through the coaxial channel 11 formed in the tie rods 4 and spread in the interior 25 of the upper casing 15, from which it will subsequently escape through the opening 30 provided in the top wall 19 of the upper casing 15.

Figure 5:
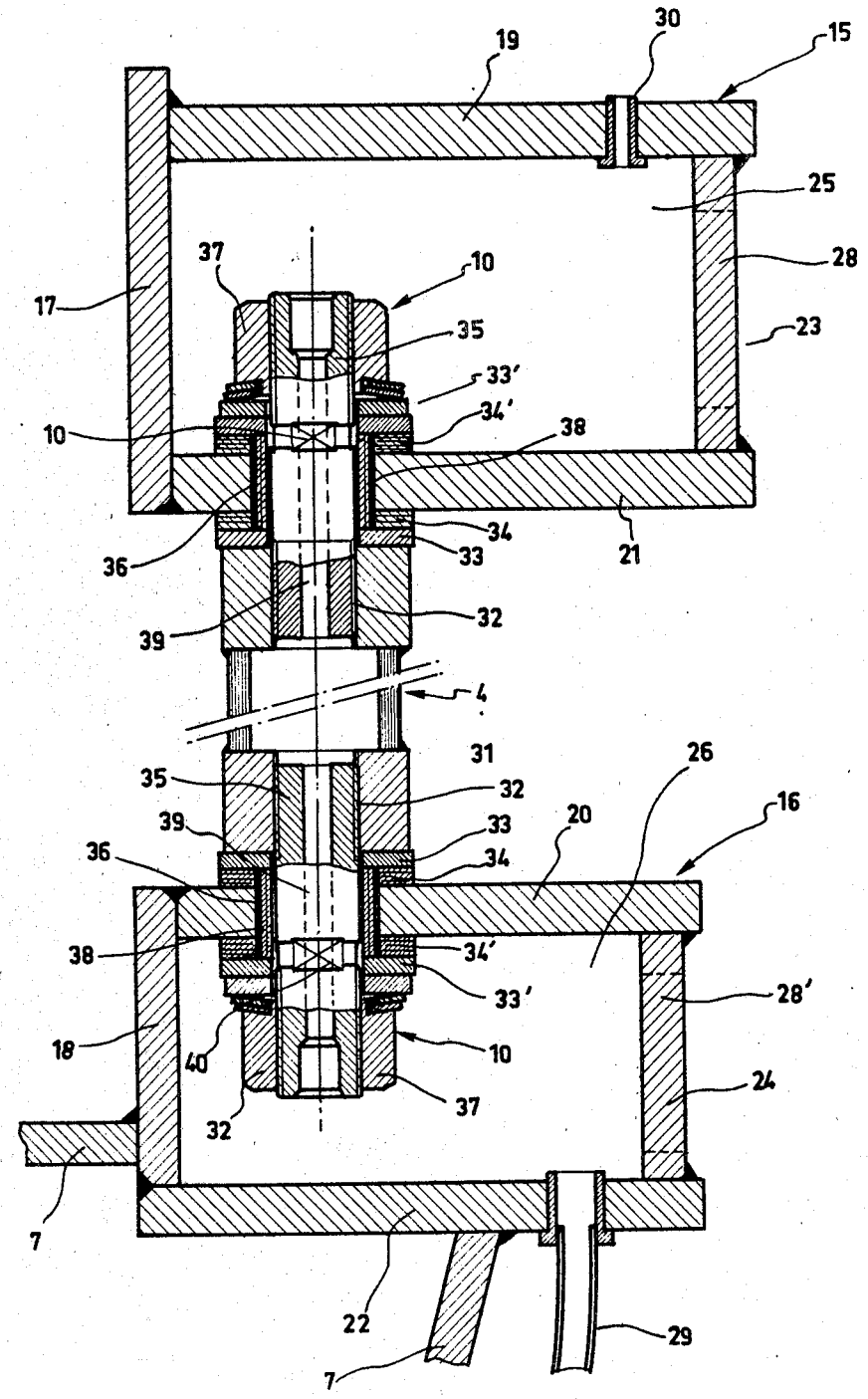
FIG. 5 is a longitudinal cross section through one tie rod provided at opposite ends with connecting means for connecting this tie rod to the upper and lower annular casings in accordance with a variation of the invention.

As can be seen from FIG. 5, the tie rods are maintained under tension between the bottom wall 21 of the upper casing 15 and the top wall 20 of the lower casing 16 by connecting means 10. Each of the tie rods 4 is constituted by a tubular rod 31, the opposite ends of which are provided in the interior thereof with screwthreads and held in abutting relationship against the upper face of the bottom wall 21 of the upper casing 15 and the bottom face of the top wall 20 of the lower casing 16, whereby washers 33 and a plurality of superimposed annular plates 34 are sandwiched between the opposite ends of the tubular rod 31 and the respective outer faces of the bottom wall 21 and the top wall 20.

The connecting means 10 are constituted by gudgeons having at least one stem 35 provided with an outer screwthread and which extends with clearance through an opening 36 provided in the bottom wall 21 of the upper casing 15, respectively through a corresponding opening 36 provided in the top wall 20 of the lower casing 16. The threaded stem portion 35 can thus be threaded into the inner thread 32 of the corresponding tie rod. The connecting means 10 may be integrally formed, provided at one of its end portions with an outer screwthread and having a shoulder at its other end integral with the stem 35, or by a gudgeon constituted by two elements separated from each other. The one-piece gudgeon is more convenient for the mounting and dismounting of the tie rods 4. On the other hand, its handling is more difficult. Either gudgeon is provided with a coaxial channel for the passage of cooling fluid therethrough.

In the embodiment illustrated in FIG. 5, the connecting means 10 are constituted by two elements which are separable from each other. In this case, a tubular stem 35 is provided with outer screwthreads at the opposite end portions thereof. One of the threaded end portions is screwed into the internal thread 32 of the respective tie rod 4, and the other threaded end portion of the stem 35 is threadingly connected with a nut 37, which permits tightening of the tie rods 4 between the bottom wall 21 of the upper casing 15 and the top wall 20 of the lower casing 16. The tightening of the nuts 37 against the internal face of the bottom wall 21 and the internal face of the top wall 20 is carried out by interposing between the nut and the respective face washers 33' and superimposed annular plates 34' identical with the washers 33 and the annular plates 34 described above.

The openings 36 in the bottom wall 21 of the upper casing 15 and in the top wall 20 of the lower casing 16 for the passage of the connecting means 10 therethrough have a diameter slightly larger than the stems 35 passing therethrough, so that a tubular joint 38 may be sandwiched between the outer periphery of the respective connecting elements and the inner periphery of the openings 36.

The joints 33, 34, 33', 34' and 38 are formed from a material which is electrically and thermally insulating. In addition, the material has to stand up properly at the temperature which may reach a few hundreds of degrees centigrade and the material has to be resistant to compression due to unavoidable expansion of the metallic structure during operation of the container. Considering these facts, the material employed is a material commercially produced under the name "Syndanio," which is composed of a compressed mixture of pulverized minerals and asbestos.

In the described embodiment, the tie rods 4 and the gudgeons 35 are respectively provided with internal channels 11 and 39 which communicate with each other to provide a passage for the cooling fluid from the interior 26 of the lower casing 16 to the interior 25 of the upper casing 15.

As previously described, the cooling fluid derived from a source not illustrated in the drawing passes through the conduit 29 into the lower casing 16. It circulates in the lower casing 16, and the tie rods 4 and the upper casing 15, to cool these elements, and finally escapes from the interior of the upper casing through the opening 30 provided in the top wall 19 thereof.

In the above description, the cooling fluid circulates in upward direction, but of course it is likewise possible to realize a downward circulation of the cooling fluid. In the latter case, the upper casing 15 is connected to the source of cooling fluid, whereas the lower casing 16 is provided with an opening for discharge of the cooling fluid.

The disconnecting of each of the tie rods 4 may be carried out in the following manner:

At first the apertures 28 and 28' are opened. Subsequently thereto the nuts 37 are unscrewed. Then the washers 33' and the annular plates 34' are removed. A planar surface 40 provided at each stem 35 at a place which is accessible after removal of the washers 33' and the annular plates 34' permits them to unscrew the stems 35 by means of an appropriate wrench. The stems 35 are thus unscrewed from the internal threads 32 of the corresponding tie rods. The released tie rods 4 may then be laterally removed. The reassembly of the tie rods with the upper and lower casings is carried out in the reverse order from that described above.

The metallurgical container of the present invention has thus the additional advantage that the operation of defective tie rods 4 can be carried out in easy manner. The replacement of the tie rods can be carried out while leaving the upper casing 15 and the lower casing 16 in place. Furthermore, the tension of the tie rods 4 between the upper casing 15 and the lower casing 16 may be adjusted in a very precise manner.

Compressed air is usually used as the cooling fluid, but it is also possible utilize another gas as well as a liquid, for example water. In the latter case, it is desirable to provide a collector at the place at which the liquid is evacuated.

It will be understood that each of the elements described above, or two or more together, may also find a useful application in other types of metallurgical containers for the inductive treatment of metal differing from the types described above.

While the invention has been illustrated and described as embodied in a metallurgical container for the inductive treatment of metal comprising an inner lining of refractory material and an outer generally tubular enclosure constituted at a median heating zone of the container by a plurality of circumferentially spaced metallic tubular tie rods electrically insulated from each other extending with opposite ends beyond the heating zone and tightly secured at the upper and lower ends respectively to an upper and a lower annular casing, one of which is supplied with a cooling fluid which is discharged from the other of the annular casings, and electrically insulating connecting means which respectively connect the upper ends of the tie rods to the bottom wall of the upper casing and the lower ends of the tie rods to the top wall of the lower casing while holding the tie rods under tension, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims:

1. A metallurgical container for inductive treatment of metal comprising an inner lining of refractory material having an upper open end and a bottom; a generally tubular enclosure having an upper portion formed as an upper annular casing surrounding said open end of said lining and having a bottom wall and a further portion formed at a median heating zone of the container by a plurality of circumferentially spaced metallic tie rods electrically insulated from each other and extending with upper and lower opposite ends beyond said heating zone, said tie rods being arranged to support said lining and so as to be easily dismountable and being tightly secured at the upper and lower ends of said enclosure, wherein said tie rods being connected by the upper ends beyond said heating zone directly and only to said bottom wall of said upper casing without being connected to other metallic parts of the container; and electrically insulating connecting means which directly connect said upper ends of said tie rods to said bottom wall of said upper casing.

2. A metallurgical container as defined in claim 1, wherein the lower portion of said enclosure is constituted by an annular lower casing having a top wall, said tie rods being connected by their lower ends beyond said heating zone directly to said top wall of said lower casing without being connected to other metallic parts of the container and including electrically insulating connecting means directly connecting said lower ends of said tie rods to said top wall of said lower casing.

3. A metallurgical container as defined in claim 2, wherein said bottom wall of said upper casing and said top wall of said lower casing are each formed with a plurality of circumferentially spaced bores therethrough, respectively aligned with each other, and wherein said connecting means comprise a plurality of elongated connecting elements provided with screwthreads at least on one end portion thereof respectively extending through said bores and respectively threadingly connected to the lower and upper ends of said tie rods.

4. A metallurgical container as defined in claim 3, wherein each of said elongated connecting elements is provided at both end portions thereof with screwthreads, the screwthread at one end of each connecting element being threadingly connected to the respective end of a tie rod and a nut threadingly connected to the screwthread at the other end of each connecting element.

5. A metallurgical container as defined in claim 4, wherein said connecting elements respectively extend with clearance through said bores and including a sleeve of insulating material surrounding the portion of each connecting element in said bore and washers of insulating material at opposite ends of each sleeve.

6. A metallurgical container as defined in claim 5, wherein each of said tie rods and each of said elongated connecting elements are provided with a channel extending in longitudinal direction therethrough respectively aligned with each other for the passage of a cooling fluid therethrough, said channels communicating respectively with said upper and said lower casings.

7. A metallurgical container as defined in claim 6, and including means for feeding a cooling fluid into one of said casings and means for discharging the cooling fluid from the other of said casings.

8. A metallurgical container as defined in claim 7, wherein each casing has an outer peripheral wall and is provided in said peripheral wall with a plurality of circumferentially spaced openings respectively arranged to provide access to said connecting elements and means for closing said openings.

* * * * *